US006779876B1

(12) United States Patent
Ingelhag

(10) Patent No.: US 6,779,876 B1
(45) Date of Patent: Aug. 24, 2004

(54) ELECTROSTATIC PRINTING DEVICE AND ELECTRODE UNIT USED IN THE ELECTROSTATIC PRINTING DEVICE

(75) Inventor: Anders Ingelhag, Gothenburg (SE)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/220,306

(22) PCT Filed: Apr. 26, 2000

(86) PCT No.: PCT/JP00/02745

§ 371 (c)(1),
(2), (4) Date: Sep. 13, 2002

(87) PCT Pub. No.: WO01/81091

PCT Pub. Date: Nov. 1, 2001

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS 4,737,803 A * 4/1988 Fujimura et al. ..... 347/67
5,801,729 A * 9/1998 Kitamura et al. ..... 347/55
6,126,275 A * 10/2000 Kagayama ..... 347/55

FOREIGN PATENT DOCUMENTS

JP 4-166348 6/1992

* cited by examiner

*Primary Examiner*—Raquel Yvette Gordon
(74) *Attorney, Agent, or Firm*—Harness, Dickey & Pierce, P.L.C.

(57) ABSTRACT

An electrode unit capable of printing images with an excellent quality and a printing device provided with this electrode unit. Rows of apertures (L1, L2) formed by disposing apertures (11) in s preset direction of a base material consisting of a resin film or a resin sheet are provided, non-image forming sections (15, 15) not used for forming images are defined along a length at least 50 times, preferably at least 200 times, the thickness of the base material extending from the opposite ends of the base material in the rows of apertures (L1, L2) lengthwise direction, and an image forming section (16) is formed in the remaining portion. Apertures (11) and control electrodes (12) surrounding the apertures (11) are used to control the transfer of toner particles to form images.

8 Claims, 7 Drawing Sheets

ELECTROSTATIC PRINTING DEVICE AND ELECTRODE UNIT USED IN THE ELECTROSTATIC PRINTING DEVICE

BACKGROUND OF THE INVENTION

1. Field of Invention

The present invention relates to an electrostatic printing device for forming an image using toner particles in printers, facsimiles, copying machines and so on, and parts therefor.

2. Description of the Prior Art

Printing devices, by which electric signals output from computers, word processors, facsimiles, or the like are formed as visible images on a recording medium such as paper or the like, include an electrostatic printing device 1 shown in FIG. 5, in which an electrode unit is arranged between a particle carrier and a back electrode.

The electrostatic printing device 1 generates an electric potential difference between the particle carrier 20 and the back electrode 30 to create an electric field, by which toner particles are conveyed toward the back electrode 30 from the particle carrier 20, and the electrode unit 10 arranged between the particle carrier 20 and the back electrode 30 controls conveyance of toner toward the back electrode 30 from the particle carrier 20 to enable forming of a desired image on a recording medium 50, such as paper or the like, or an intermediate recording medium, such as a transfer belt or the like, disposed between the particle carrier 20 and the back electrode 30.

The above-mentioned electrode unit 10 comprises apertures 11 and control electrodes 12 surrounding the apertures 11 at least partially (see FIG. 6), and voltage applied on the control electrodes 12 has an influence on an electric field, by which toner particles are conveyed toward the back electrode 30, so that toner particles conveyed toward the back electrode 30 from the particle carrier 20 determine positions, sizes and the like of dots formed on the recording medium 50.

The electrode unit 10 is formed from a base material of a resin film or resin sheet composed of, for example, a resin material such as polyimide or the like and having a thickness of around 25 to 200 $\mu$m, the base material being formed with a plurality of apertures 11 aligned in a predetermined direction, and the apertures 11 being formed to be at least partially surrounded by, for example, mutually intersecting control electrodes or the control electrodes 12 formed in a ring-shaped fashion.

When being assembled into the printing device 1, the electrode unit 10 is disposed between the particle carrier 20 and the back electrode 30 such that rows of the apertures (L1 to L4) of the unit 10 are made in parallel to an axis of the particle carrier 20, which is formed as a column or cylinder-shaped rotating body.

In the example shown in FIG. 5, the electrode unit 10 is formed with four rows of apertures (L1 to L4) disposed in parallel. In the case where the plural rows of apertures (L1 to L4) are provided in the electrode unit 10, a distance between the surface of the particle carrier 20 and the apertures 11 formed on the electrode unit 10 varies depending upon, for example, to which of the rows of apertures (L1 to L4) the apertures 11 belong, when the electrode unit 10 is positioned in a planar manner.

In the specification of the present application, assuming that Lk denotes a distance between the respective apertures 11 of the electrode unit 10 and the surface of the particle carrier 20, Lk is large between the apertures 11 belonging to the right and left rows (L1, L4) in FIG. 5 and the surface of the particle carrier 20 and small between the apertures 11 belonging to the central rows (L2, L3) and the surface of the particle carrier 20. Also, since even with an electrode unit 10 comprising one or two rows of apertures, it is difficult to arrange the row or rows of apertures in completely parallel to the axis of the particle carrier, Lk is in some cases varied in the apertures 11 belonging to the same row. Therefore, as Lk is varied, the control electrodes 12 have different influences on an electric field formed between the particle carrier 20 and the back electrode 30 even in the case where the same voltage is applied to the control electrodes 12 surrounding the apertures 11 in the respective rows (L1 to L4) of apertures, so that dots formed on the recording medium 50, such as paper or the like, vary in size and density depending upon which of the control electrodes 12 surrounding the apertures 11 has controlled the forming of the dots.

By way of example, in the case where dots are formed on the recording medium 50 assuming that all the control electrodes 12 surrounding the apertures 11 (L1 to L4) formed on the electrode unit 10 in the printing device 1 shown in FIG. 5 are the same in electric potential, when the apertures 11 belonging to the rows L2, L3 and having a relatively small distance Lk between them and the surface of the particle carrier 20 form relatively deep and large dots, and the apertures 11 belonging to the rows L1, L4 and having a relatively small distance Lk between them and the surface of the particle carrier 20 form light and small dots, quantity of toner particles adhered to a printed surface finished and sizes of dots formed differ depending upon, through which of the apertures 11 adherence of toner particles and formation of dots are made, when dots are consecutively shown in, for example, FIG. 6, so that there are produced areas being uneven in density and not printed, such unevenness and non-printed areas being visually recognized as lines.

Such phenomenon is called "white line noise", which causes degradation in printing quality, and removal of which is contemplated. In order to prevent generation of such "white line noise", distances Lk between the surface of the particle carrier 20 and the apertures 11 formed on the electrode unit 10 are made constant to eliminate variation $\Delta$Lk in the distances, thereby solving the problem of "white line noise". Therefore, there has been proposed a printing device (see FIG. 7) constructed such that distances Lk between the apertures 11 of the electrode unit 10 and the surface of the particle carrier 20 are made uniform in all the rows (L1 to L4) by bending that area of the electrode unit 10, in which the apertures 11 are formed, so that all the apertures 11 are adjusted to be disposed on a circle concentric with an outer periphery of the particle carrier 20.

As described above, with the printing device 1, in which the area of the electrode unit 10 formed with the apertures 11 is bent in compliance with the surface configuration of the particle carrier 20, all the distances Lk between the surface of the particle carrier 20 and the respective rows (L1 to L4) of the apertures of the electrode unit 10 are uniform, and therefore it is possible to prevent that degradation in printing quality, which is attributed to unevenness in such distances.

When the electrode unit 10 formed from a base material of a resin film or resin sheet is bent in a certain direction, the cross section of the bent portion itself undergoes deformation in its inner surface with the result that such deformation causes the electrode unit 10 to change in shape.

For example, when an X—X axis of an electrode unit 10 put in a state of being disposed in a planar position shown in FIG. 8 is bent into a shape shown by a broken line X'—X' as shown in FIG. 9, the electrode unit 10 generates warp ρ at both ends in the direction along a Z—Z axis perpendicular to the X—X axis thus bent (see FIG. 9).

FIG. 10 shows a state of a minute space containing an origin O and cut from the bent portion of the electrode unit 10 put in the state shown in FIG. 9. When the electrode unit 10 is bent in a widthwise direction in a square column above the origin O (above the broken line) in FIG. 10, normal stress acts to compress the electrode unit 10 in the direction along the X—X axis, thereby generating longitudinal strain $\epsilon_x$ and lateral strain $\epsilon_x(=-\nu\epsilon_x)$ in the direction along the Z—Z axis since the electrode unit 10 compressed by the normal stress tends to expand in a lateral direction.

Also, stress and strain in a state opposite to the above are generated in a square column below the origin O (below the broken line) in FIG. 10. Therefore, when the electrode unit 10 is bent in the direction along the X—X axis, stress is generated in the direction along the Z—Z axis to tend to bend the electrode unit 10. This stress is liable to be released at ends of the substrate, so that "warp" which affects the print quality is caused in both end portions of the substrate in the direction along the Z—Z axis (see FIG. 11).

Thus, when the electrode unit 10 is bent in the direction perpendicular to the rows of apertures, "warp" is produced in both longitudinal end portions of the rows of apertures, so that degradation in printing quality is caused in the case where apertures 11 are formed up to end portions of the electrode unit 10 and all the apertures 11 are used for formation of an image. That is, the apertures 11 formed in both end portions of the electrode unit 10 are displaced in directions away from the surface of the particle carrier 20 to make distances Lk large to generate dispersion between the apertures 11 in the same rows. Therefore, in the case where such displacement is generated to a degree having an influence on printing quality, that is, beyond an error in an allowable range, dots formed are different in size and density between the respective apertures 11 to cause degradation in printing quality.

However, there have not been conventionally proposed any method and device for dissolving that degradation in image quality, which is caused by "warp" generated in both longitudinal end portions of an electrode unit 10.

Accordingly, the present invention has been made with a view to overcoming the above disadvantages of the prior art and has its object to provide an electrode unit capable of forming an image of excellent quality by eliminating variations in distances between apertures formed on an electrode unit and the surface of a particle carrier as far as possible even if "warp" is generated at both end portions of rows of apertures in a longitudinal direction of rows of apertures when the electrode unit is bent in the direction perpendicular to the rows of apertures.

SUMMARY OF THE INVENTION

In order to attain the above object, an electrostatic printing device 1 and an electrode unit 10 used for the electrostatic printing device 1 according to the present invention are provided, the electrostatic printing device comprising a column-shaped or cylinder-shaped particle carrier 20 carrying toner particles on the surface thereof, a back electrode 30 disposed opposite the particle carrier 20 and an electrode unit 10 arranged between the particle carrier 20 and the back electrode 30 and formed with a plurality of apertures 11, which are at least partially surrounded by control electrodes 12, and wherein electric voltage producing an electric potential difference between the particle carrier 20 and the back electrode 30 and applied to the control electrodes 12 of the electrode unit 10 controls conveyance of toner particles toward the back electrode 30 from the particle carrier 20 to form a desired image on a recording medium 50 disposed between the particle carrier 20 and the back electrode 30, and the electrode unit 10 comprises a substrate formed from a resin film or resin sheet, the apertures 11 being arranged in a predetermined direction of the substrate to provide rows of apertures (L1, L2), the rows of apertures (L1, L2) on the electrode unit 10 being arranged in the direction parallel to an axis of the particle carrier 20, the electrode unit 10 being arranged to be curved in the direction perpendicular to the longitudinal direction of the rows of apertures (L1, L2), and the respective rows of apertures (L1, L2) being positioned equidistantly from an outer periphery of the particle carrier 20, and wherein when the substrate is bent in the direction perpendicular to the rows of apertures (L1, L2), the substrate curves in the longitudinal direction of the rows of apertures (L1, L2) to create an image forming area 16 defined by that portion on the substrate, in which displacements (variations ΔLk) produced in directions away from the surface of the particle carrier 20 are in a predetermined range of allowable error, and image unforming areas 15, 15 being not used for formation of an image and defined by those areas, which extend from both ends of the image forming area to both ends of the substrate.

In addition, the image unforming areas 15, 15 may comprise areas, in which the apertures 11 are not formed, and the apertures 11 may be formed. However, the apertures 11 formed in the image unforming areas 15, 15 are not used for formation of an image.

The image unforming areas 15, 15, respectively, are provided to extend over a length fifty times or more, more preferably, two hundred times or more a thickness of the substrate in the longitudinal direction of the rows of apertures.

BRIEF DESCRIPTION OF THE DRAWINGS

The objects and advantages of the invention will become understood from the following detailed description of preferred embodiments thereof in connection with the accompanying drawings in which like numerals designate like elements, and in which.

DETAILED DESCRIPTION OF THE PREFERRED EMBODIMENTS

An embodiment of the present invention will be described below with reference to the accompanying drawings.

Figure 1:
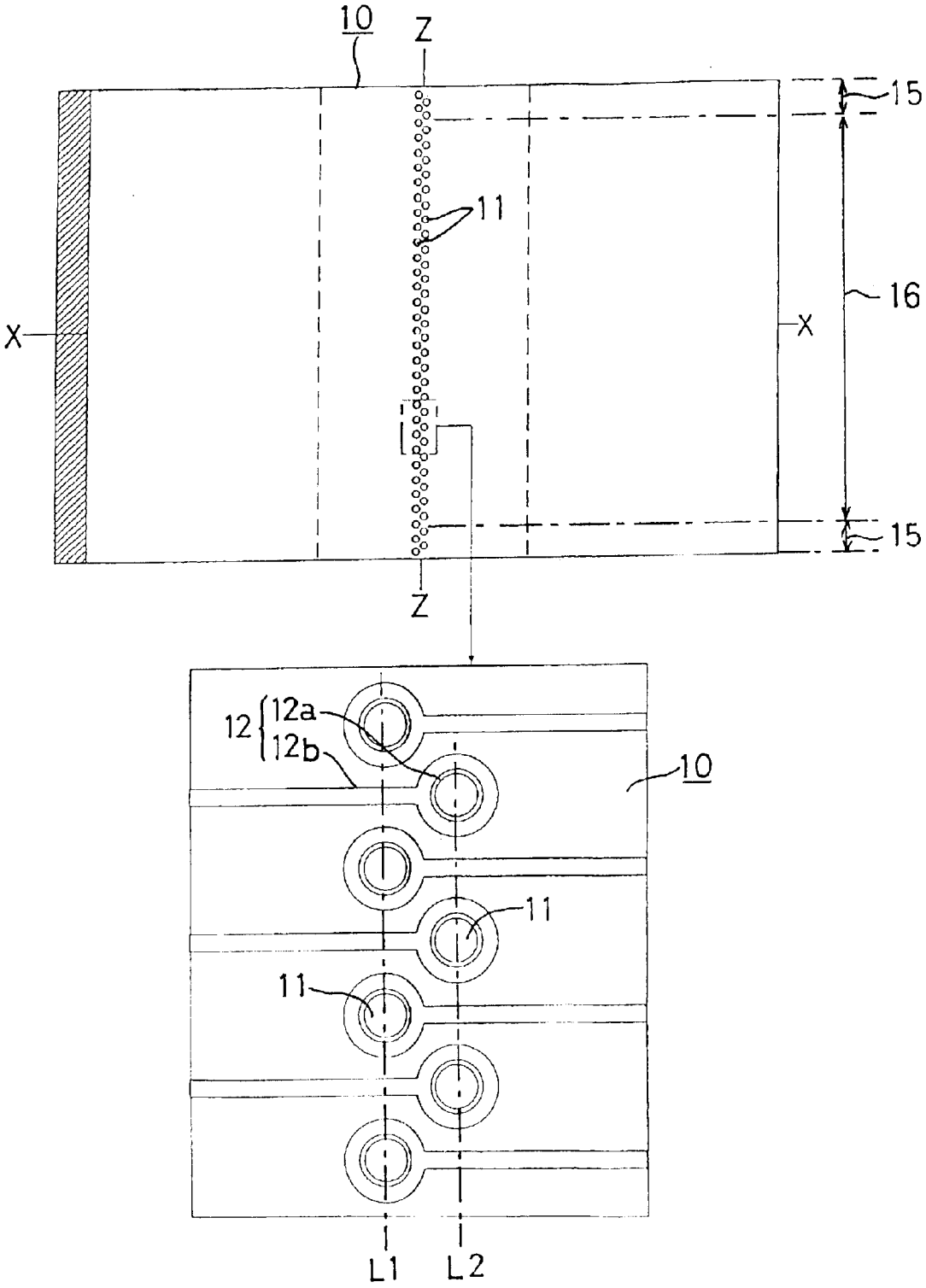
FIG. 1 is a plan view showing an electrode unit according to the present invention.

In FIG. 1, the reference numeral 10 denotes an electrode unit according to the present invention. The electrode unit 10 is called a flexible printed board (FPC) and is formed from a base material of a resin film or resin sheet composed of, for example, a resin material such as polyimide or the like and having a thickness of around 25 to 200 μm, and formed with a multiplicity of apertures 11 extending through the base material, the apertures 11 being formed to be at least partially surrounded by a control electrodes 12. In the present embodiment, the many apertures 11 having a diameter of around 160 μm are formed in the base material having a diameter of 100 μm to form the electrode unit 10.

The control electrodes 12 are shown as comprising ring-shaped portions 12*a* surrounding the respective apertures 11 and lead portions 12*b* for connecting the ring-shaped portions 12*a* of the respective control electrodes 12 to an electric voltage source (not shown) in the embodiment shown in FIG. 1. The control electrodes 12 is not limited to a configuration shown in FIG. 1 but may be one, in which a plurality of intersecting control electrodes surround the apertures at least partially, and one, in which control electrodes are provided to surround a plurality of apertures 11 at a time, and can use various known configurations.

Also, the control electrodes 12 may be formed on either of front and back surfaces of the above base material composed of a resin film or resin sheet, or may be formed on both surfaces of the base material, or further may be embedded in and disposed on the base material, and is not limited to arrangement, configuration and the like provided that conveyance of toner particles toward the back electrode 30 can be controlled.

In the embodiment shown in FIG. 1, the apertures 11 are arranged in the direction along the line Z—Z to define rows (L1, L2) of apertures, and a plurality of rows (L1, L2) of apertures are arranged in parallel in the direction along the line X—X, so that two rows. (L1, L2) of apertures are formed in the embodiment shown in FIG. 1.

It should be noted that these rows (L1, L2) of apertures are not limited to two-row arrangement but may be arranged in two or more rows and can also be applied to one row arrangement.

With the electrode unit 10 constituted in the above manner, an image is formed through the apertures 11 formed in an image forming area 16, and image unforming areas 15, 15 being not used for formation of an image are formed on both ends of the image forming area 16.

The image forming area 16 used for formation of an image comprises that portion on the substrate, in which displacements (variations ΔLk) produced in directions away from the surface of the particle carrier 20 are in a predetermined range of allowable error when the substrate of the electrode unit curves in a longitudinal direction (direction along the line Z—Z in FIG. 1) of the rows (L1, L2) of apertures after the substrate is bent in the direction (direction along the line X—X in FIG. 1) perpendicular to the rows (L1, L2) of apertures, and the apertures 11 formed in the image forming area 16 and the control electrodes 12 surrounding the apertures 11 control conveyance of toner particles to control positions, sizes and densities of dots formed. Also, the image unforming areas 15, 15 being not used for formation of an image are formed on those areas of the substrate, which extend from both ends of the image forming area 16 to both ends of the substrate.

In what extent the image unforming areas 15, 15 should be provided, that is, what extent from both ends of the electrode unit 10 correspond to those portions, in which large variations ΔLk are generated, is determined by a thickness of the substrate of the electrode unit 10 such that large variations ΔLk are generated in portions at a distance fifty times or less the thickness of the substrate, more surely a distance two hundred times or less the thickness of the substrate, from both ends of the electrode unit 10. Therefore, those portions define the image unforming areas 15, 15 and the remaining portion defines the image forming area 16, in which the apertures 11 and the control electrodes 12 surrounding the apertures 11 control conveyance of toner particles to form an image, thereby enabling prevention of degradation in printing quality.

In the present embodiment, the resin substrate of the electrode unit 10 has a thickness of about 100 μm, so that the image unforming areas 15, 15 are provided over lengths of 5 mm, more surely 2 cm or more from both ends of the electrode unit 10 whereby degradation in printing quality can be prevented even if "warp" of the substrate occurs at both longitudinal ends thereof.

In addition, while the apertures 11 are also formed in the image unforming areas 15, 15 in the present embodiment shown in FIG. 1, the apertures 11 may not be formed in the image non-forming areas 15, 15. In the case where the apertures 11 are formed in the image unforming areas 15, 15, the apertures 11 formed in the image unforming areas 15, 15 should not be used for formation of an image by not connecting to the control electrodes 12 surrounding those apertures to a voltage source (not shown). Thus, in the case where the apertures 11 are formed not only in the image forming area 16 but also in the image unforming areas 15, 15, there is no need of any complex work for forming (or not forming) the apertures 11 partially in manufacture of the electrode unit 10, so that the electrode unit 10 can be manufactured easily.

In this manner, the image unforming areas 15, 15 being not used for formation of an image are provided over a distance fifty times or less the thickness of the substrate of the electrode unit 10, more surely a distance two hundred times or less the thickness of the substrate in both ends of the electrode unit 10 in the longitudinal direction of the rows of apertures, whereby it is possible to prevent that dispersion in distances Lk between the apertures 11 and the surface of the particle carrier 20, which is caused by "warp" produced at both longitudinal ends of the rows of apertures when the electrode unit 10 is bent in the direction perpendicular to the rows of apertures as described later.

Figure 2:
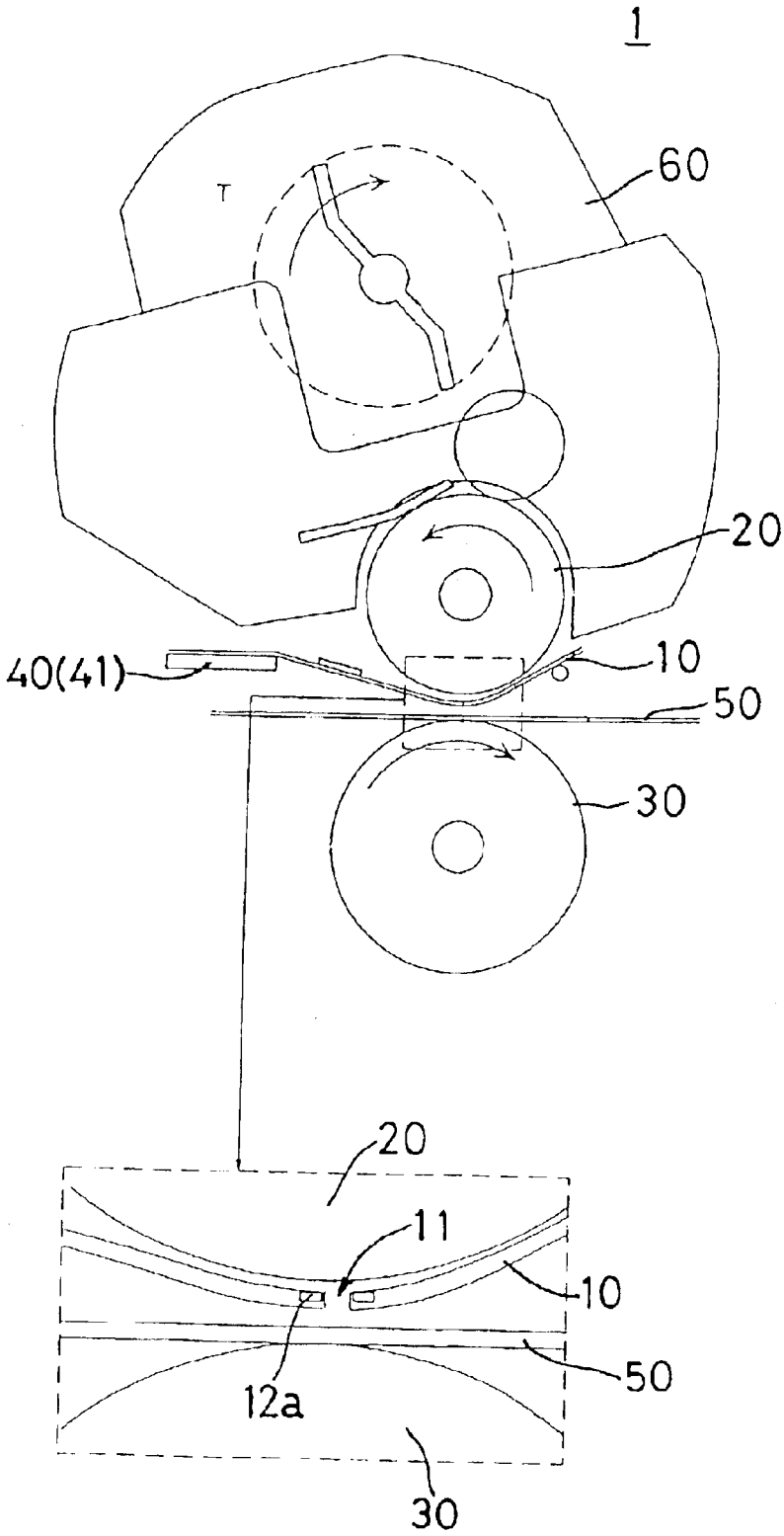
FIG. 2 is a schematic view illustrating a printing device according to the present invention.

The electrode unit 10 constituted in the above manner is arranged between the particle carrier 20 and the back electrode 30 to form a printing device 1 shown in FIG. 2 while that area, in which the apertures 11 are formed, is bent in compliance with a circle concentric with the outer peripheral shape of the particle carrier 20.

In FIG. 2, the electrostatic printing device 1 comprises the particle carrier 20 formed in a cylindrical-shape, the back electrode 30, and the electrode unit 10 arranged between the particle carrier 20 and the back electrode 30.

In the electrostatic printing device 1, the particle carrier 20 is in the form of a column-shaped or cylinder-shaped rotating body, and constructed such that upon rotation of the particle carrier 20, toner particles T filled in a container 60 adhere to the surface of the particle carrier 20 to be conveyed thereby.

In the case where, for example, toner of magnetic substance is used as toner particles, the particle carrier 20 may be formed in the form of a cylinder, in which magnets are arranged, and may be constructed to be able to electrically adhere toner particles to the surface thereof, and can adopt various known configurations.

In this manner, upon rotation of the particle carrier 20, toner particles having adhered to the surface of the particle carrier 20 are conveyed to a position, in which the apertures 11 of the electrode unit 10 are formed, and toner particles can be conveyed toward the back electrode 30 by an electric field formed by electric potential difference given between the particle carrier 20 and the back electrode 30.

In the electrostatic printing device 1, the electrode unit 10 arranged between the particle carrier 20 and the back electrode 30 is constructed to be held in a curved state so that distances Lk between the apertures 11 in the rows (L1, L2) of apertures formed on the electrode unit 10 and the surface of the particle carrier 20 are made uniform.

In order to hold the electrode unit 10 in a curved state, the printing device 1 in the present embodiment comprises holding means 40 for the electrode unit 10. An example of the holding means 40 is shown in FIG. 3, and the holding means 40 for holding the electrode unit 10 of the present invention in a curved state is not limited to a configuration shown in FIG. 3.

Figure 3:
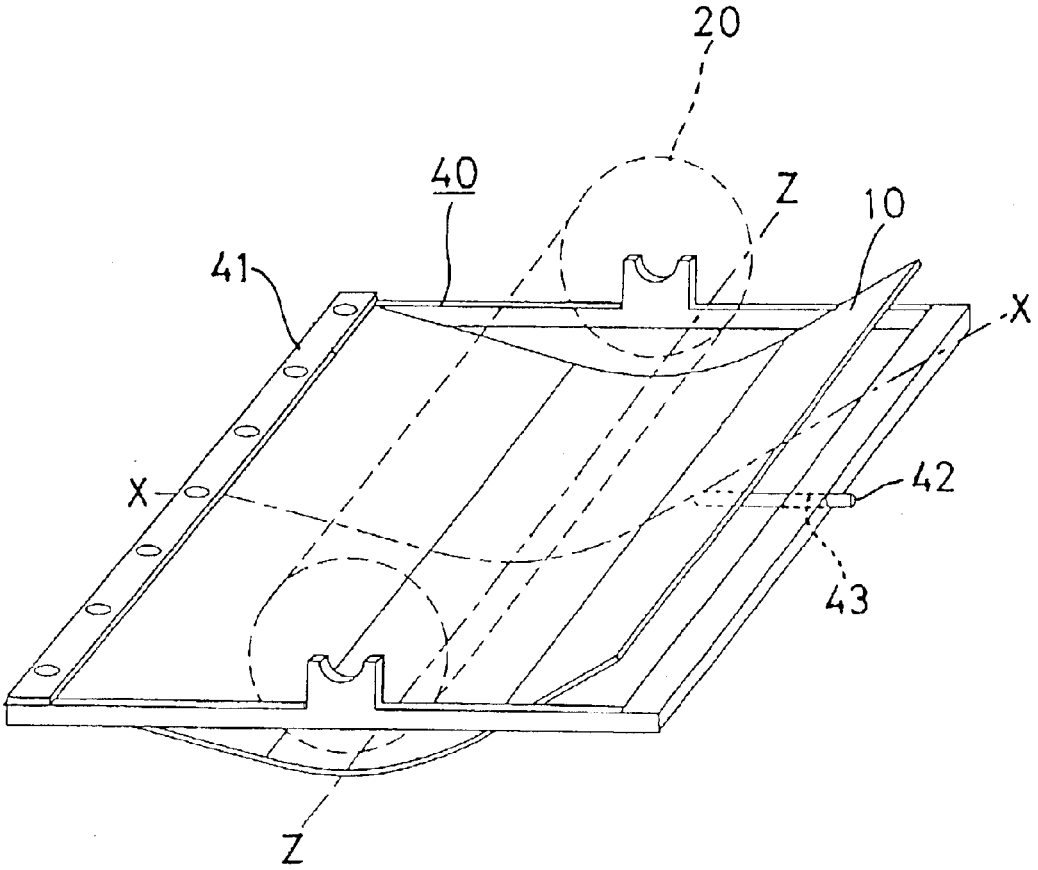
FIG. 3 is an explanatory view showing holding means, to which the electrode unit is mounted.

In FIG. 3, the holding means 40 comprises a frame formed to be substantially rectangular-shaped, and the electrode unit 10 formed to be rectangular-shaped is arranged in the frame. A side of the electrode unit 10 is, for example, interposed between holding portions 41 provided on a side of the holding means 40 to be fixed at its one end, and a side facing the above side is made a free end which is not fixed to the holding means 40.

Further, the holding means 40 comprises pressing means 42 provided on a side thereof opposite to the side, on which the holding portions 41 are formed, and for pushing a free end side of the electrode unit 10 upward and bending the same in FIG. 3, the pressing means 42 in the present embodiment comprising a push pin inserted into a hole 43 formed in a side of the frame of the holding means 40 to be able to advance or retract and extending through the frame in FIG. 3.

Figure 4:
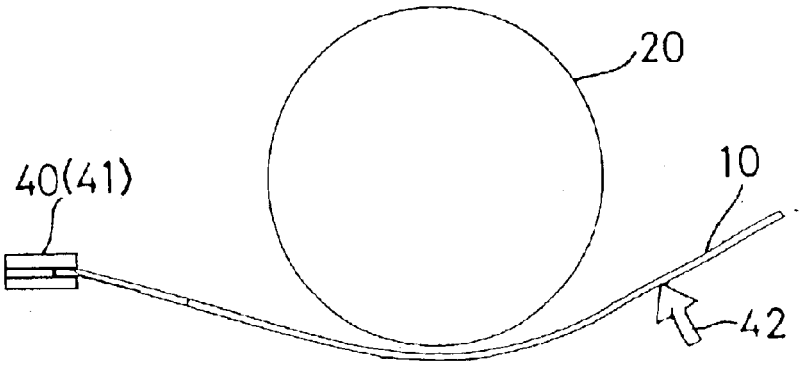
FIG. 4 is an explanatory view showing an example, in which the electrode unit is mounted to the holding means.
Figure 5:
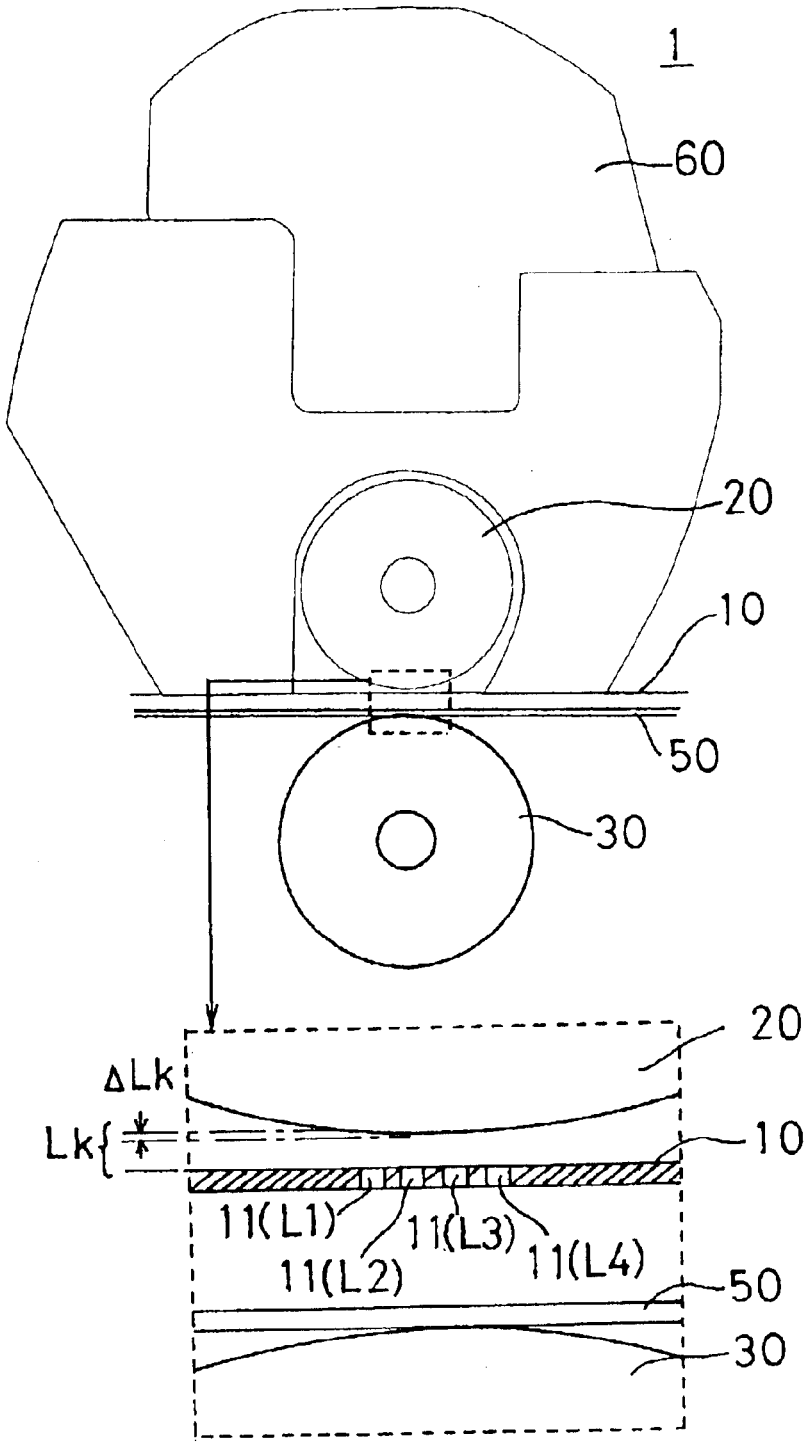
FIG. 5 is a schematic view illustrating a conventional printing device.

When a side of the electrode unit 10 is interposed between the holding portions 41 of the holding means 40 constructed in the above manner and the free end side of the electrode unit 10 is pushed up by the above pushing pin 42, the electrode unit 10 formed from a resin material such as polyimide or the like to posses flexibility is curved as shown in FIG. 4. A position, in which the electrode unit 10 is bent, can be adjusted by advancing and retracting the pushing pin 42 such that bending of the electrode unit 10 can be generated near and toward the holding portions 41 by moving the pushing pin 42 toward the holding portions 41 and bending of the electrode unit 10 can be shifted away from the holding portions 41 by moving the pushing pin 42 in the direction away from the holding portions 41, such adjustment enabling bending of the electrode unit 10 to correspond to a position, in which the apertures 11 are formed.

The curved electrode unit 10 is arranged to conform to the outer periphery of the particle carrier 20 in the form of a columnar or cylindrical configuration, and the respective apertures 11 are made equidistant from the outer periphery of the particle carrier 20.

In addition, the electrode unit 10 may be arranged in such a manner that either or both of portions disposed right and left of that area, in which the apertures 11 are formed, contact the surface of the particle carrier 20 in FIG. 4, in which case a material involving less frictional resistance may be adhered to the contact portion between the electrode unit and the particle carrier 20.

In this manner, the electrode unit 10 arranged between the particle carrier 20 and the back electrode 30 is constructed such that the control electrodes 12 surrounding the apertures 11 are connected to a voltage source (not shown) and when a predetermined voltage is applied to the control electrodes 12 through a control device (not shown) or the like, conveyance of toner particles toward the back electrode 30 from the particle carrier 20 is controlled to form a desired image on a recording medium 50, such as paper or the like, disposed between the particle carrier 20 and the back electrode 30.

Figure 6:
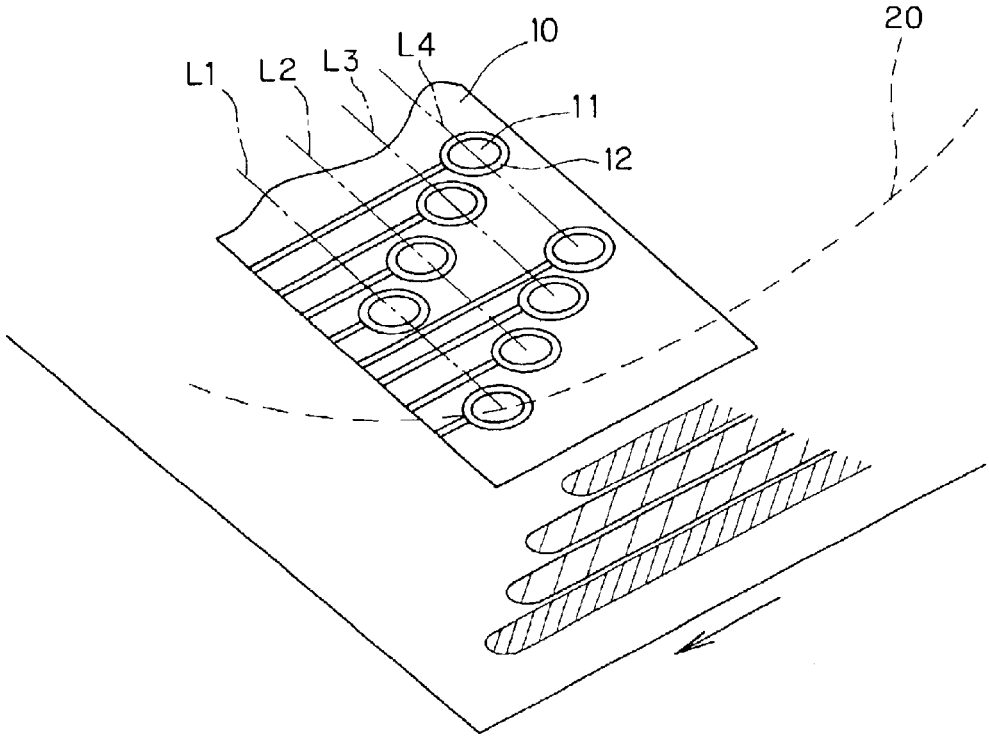
FIG. 6 is a view illustrating the generation of white line noise.
Figure 7:
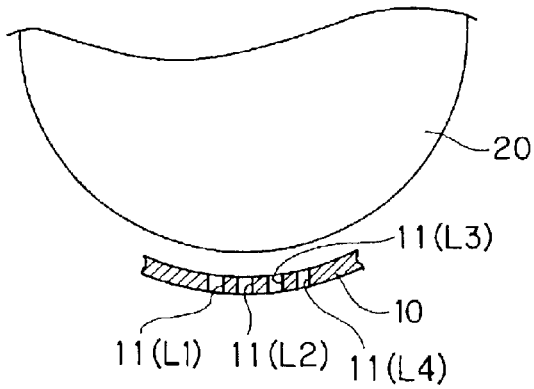
FIG. 7 is a schematic view illustrating a conventional printing device with an electrode unit curved.
Figure 8:
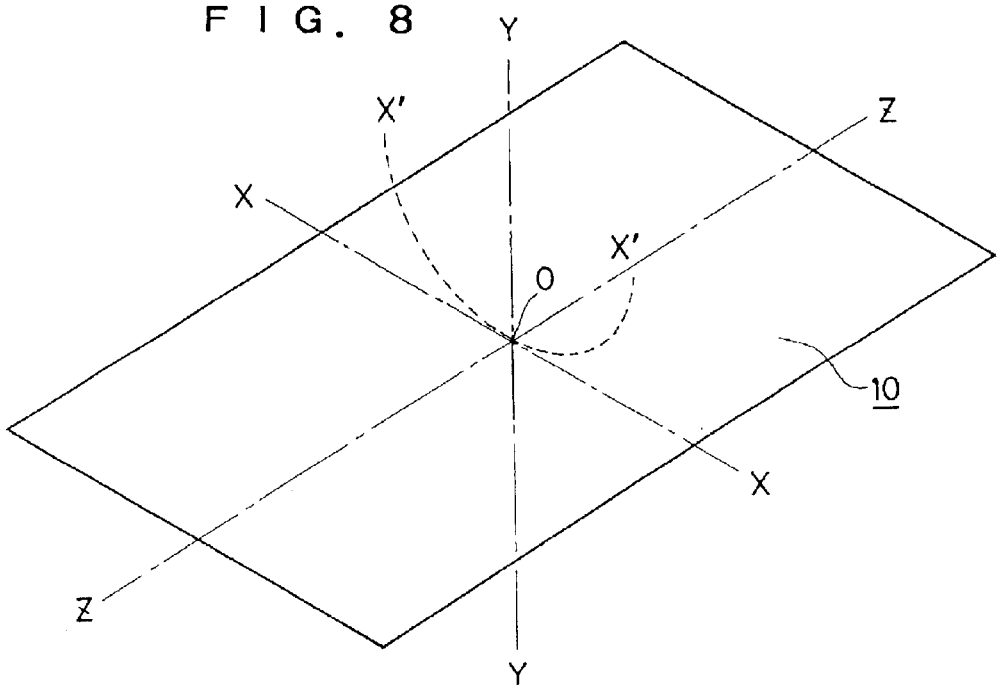
FIG. 8 is a view illustrating an electrode unit.
Figure 9:
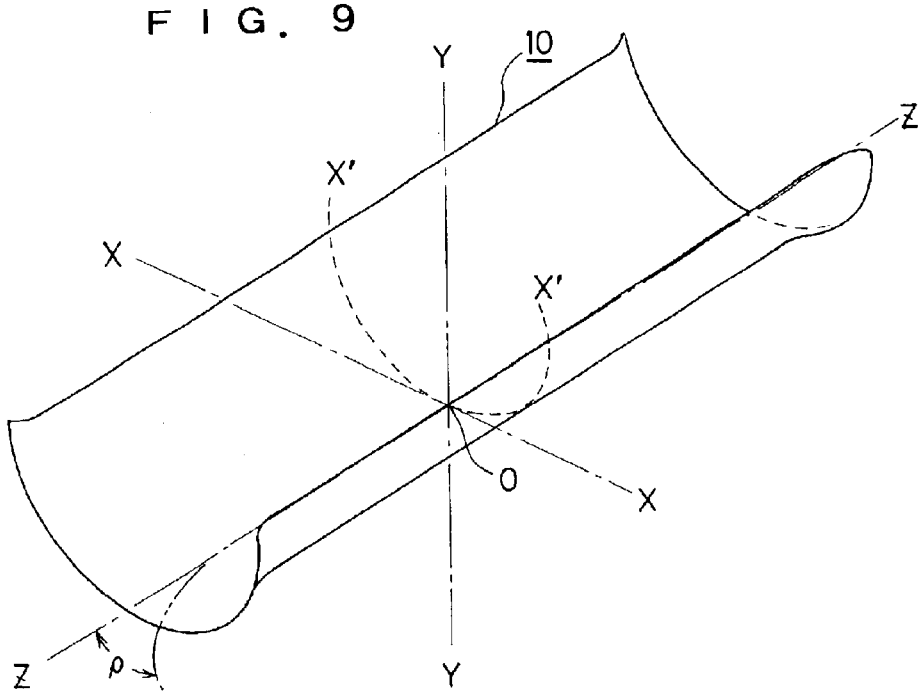
FIG. 9 is a view illustrating an electrode unit in a curved state.
Figure 10:
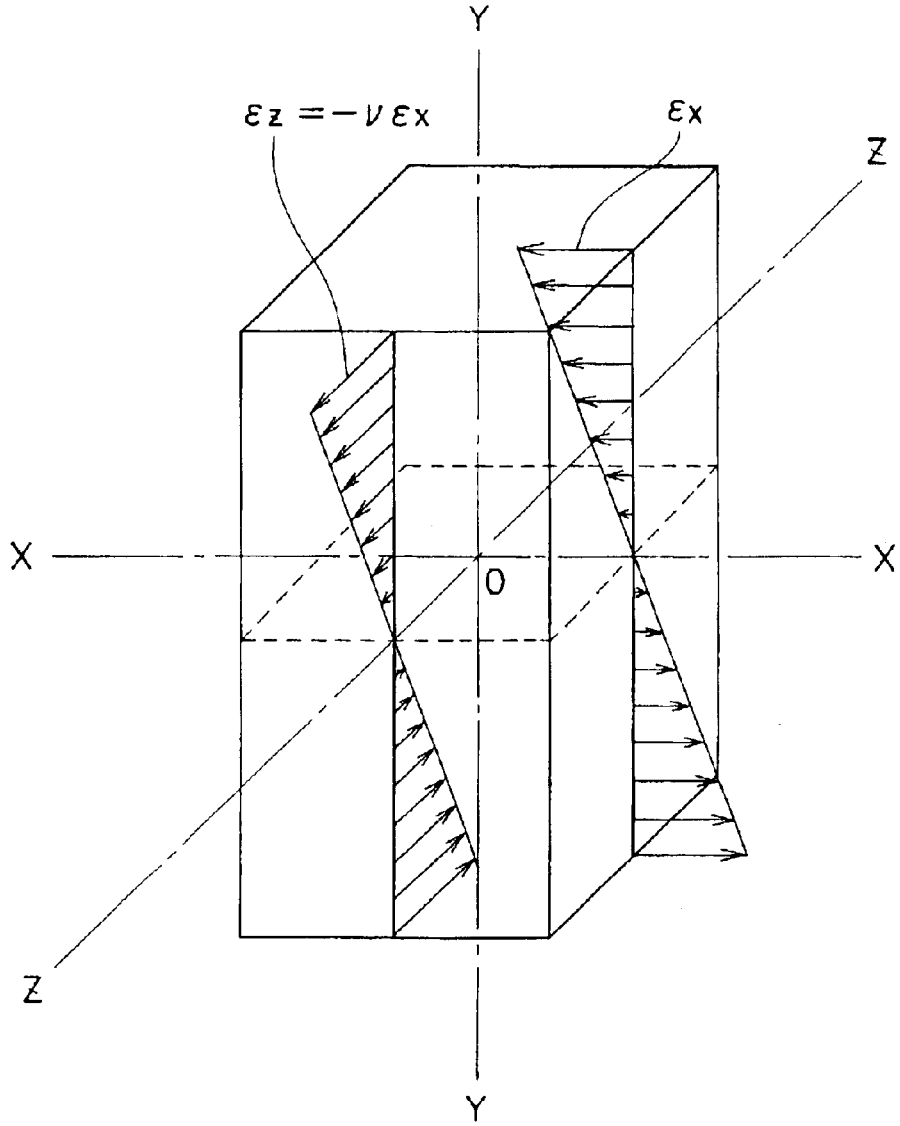
FIG. 10 is a view illustrating how strain is generated in an electrode unit in a curved state.
Figure 11:
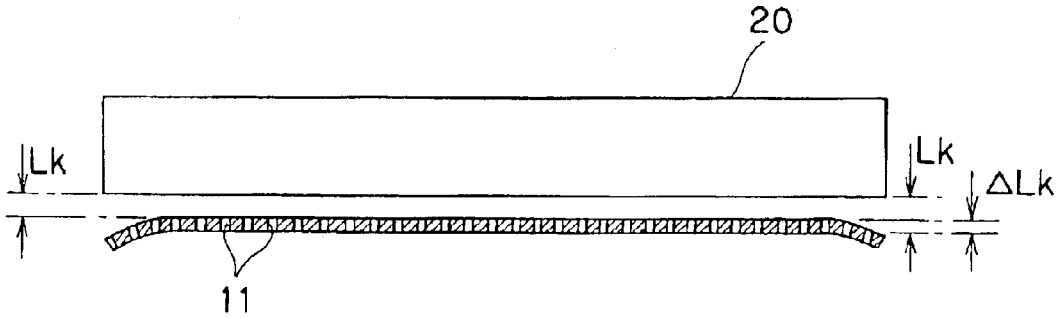
FIG. 11 is a view illustrating "warp" in a longitudinal direction of the electrode unit.

The electrode unit constituted in the above manner and the printing device provided with the electrode unit are arranged in a state, in which the image forming area of the electrode unit is curved to be able to be disposed on a circle concentric with the outer periphery of the particle carrier which is formed into a columnar or cylindrical shape, so that all distances between the respective apertures formed on the electrode unit and the surface of the particle carrier become the same whereby unevenness in printing among the apertures in the respective rows is eliminated, dots printed through the respective apertures are of the same size and the same density, and printing quality is improved without generation of "white line noise" as shown in FIG. 6.

Also, when the electrode unit is bent in the direction perpendicular to the rows of apertures, the substrate of the electrode unit curves in a longitudinal direction of the rows of apertures to create an image forming area defined by that portion on the substrate, in which displacements produced in directions away from the surface of the particle carrier are in a predetermined range of allowable error, and image unforming areas being not used for formation of an image and defined by those portions, which extend from both ends of the image forming area to both ends of the electrode unit, whereby it is possible to provide an electrostatic printing device and an electrode unit used for the same, in which no conspicuous error is generated in distances between the apertures and the particle carrier due to the warp generated in the longitudinal direction of the rows of apertures of the electrode unit caused by bending of the electrode unit, and dots formed can be made as uniform as possible in size and density.

Thus the broadest claims that follow are not directed to a machine that is configure in a specific way. Instead, said broadest claims are intended to protect the heart or essence of this breakthrough invention. This invention is clearly new and useful. Moreover, it was not obvious to those of ordinary skill in the art at the time it was made, in view of the prior art when considered as a whole.

Moreover, in view of the revolutionary nature of this invention, it is clearly a pioneering invention. As such, the claims that follow are entitled to very broad interpretation so as to protect the heart of this invention, as a matter of law.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrated and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In electrostatic printing device comprising a column-shaped or cylinder-shaped particle carrier carrying toner particles on the surface thereof, a back electrode disposed opposite the particle carrier, and an electrode unit arranged between the particle carrier and the back electrode and formed with a plurality of apertures which are at least partially surrounded by control electrodes, and wherein electric voltage producing an electric potential difference between the particle carrier and the back electrode and applied electric voltage to the control electrodes of the electrode unit for controlling conveyance of toner particles toward the back electrode from the particle carrier to form a desired image on a recording medium disposed between the particle carrier and the back electrode, characterized in that;

the electrode unit including:

a base material of a resin film or resin sheet, the apertures being arranged in a predetermined direction of the substrate to provide rows of apertures, the rows of apertures on the electrode unit being arranged in the direction parallel to an axis of the particle carrier, and the electrode unit being arranged to be curved in the direction perpendicular to a longitudinal direction of the rows of apertures, and wherein when the substrate is bent in the direction perpendicular to the rows of apertures, the substrate curves in the longitudinal direction of the rows of apertures to create an image forming area defined by that portion on the substrate, in which displacements produced in directions away from the surface of the particle carrier are in a predetermined range of allowable error, and image unforming areas being not used for formation of an image and defined by those portions, which extend from both ends of the image forming area to both ends of the substrate.

2. The electrostatic printing device according to claim 1, wherein the image unforming areas form non-apertures areas, which having no apertures.

3. The electrostatic printing device according to claim 1, wherein the image unforming areas, respectively, are provided to extend over a length fifty times or more a thickness of the substrate in the longitudinal direction of the rows of apertures.

4. The electrostatic printing device according to claim 1, wherein the image unforming areas, respectively, are provided to extend over a length two hundred times or more the thickness of the substrate in the longitudinal direction of the rows of apertures.

5. In an electrode unit for use in an electrostatic printing device comprising a column-shaped or cylinder-shaped particle carrier carrying toner particles on the surface thereof, a back electrode disposed opposite the particle carrier, and an electrode unit arranged between the particle carrier and the back electrode and formed with a plurality of apertures, which are at least partially surrounded by control electrodes, and wherein electric voltage producing an electric potential difference between the particle carrier and the back electrode, and applied to the control electrodes of the electrode unit controls conveyance of toner particles toward the back electrode from the particle carrier to form a desired image on a recording medium disposed between the particle carrier and the back electrode, and characterized in that;

the electrode unit including:

a base material formed of a resin film or resin sheet, the apertures being arranged in a predetermined direction of the substrate to provide rows of apertures, and wherein that portion on the substrate, in which displacements from original positions, produced by that curvature in the longitudinal direction of the rows of apertures, which is generated when the substrate is bent in the direction perpendicular to the rows of apertures, are in a predetermined range of allowable error, serves as an image forming area, and those portions extending from both ends of the image forming area to both ends of the substrate serve as image unforming areas being not used for formation of an image.

6. The electrode unit for use in an electrostatic printing device according to claim 5, wherein the image unforming areas form non-apertures areas, which having no apertures.

7. The electrode unit for use in an electrostatic printing device, according to claim 5, wherein the image unforming areas, respectively, are provided to extend over a length fifty times or more a thickness of the substrate in the longitudinal direction of the rows of apertures.

8. The electrode unit for use in an electrostatic printing device, according to claim 5, wherein the image unforming areas, respectively, are provided to extend over a length two hundred times or more the thickness of the substrate in the longitudinal direction of the rows of apertures.

* * * * *